US007766102B2

(12) United States Patent
Stroud et al.

(10) Patent No.: US 7,766,102 B2
(45) Date of Patent: Aug. 3, 2010

(54) DOWNHOLE ASSEMBLY AND CUTTER ASSEMBLY

(75) Inventors: Daryl Richard Henry Stroud, Gloucester (GB); Robert Donald John Sedgeman, Gloucester (GB); Colin Walker, Tideswell (GB)

(73) Assignee: Smart Stabilizer Systems Limited, Ashchurch Tewkesbury (GB)

( * ) Notice: Subject to any disclaimer, the term of this patent is extended or adjusted under 35 U.S.C. 154(b) by 0 days.

(21) Appl. No.: 12/279,484

(22) PCT Filed: Feb. 13, 2007

(86) PCT No.: PCT/GB2007/000477

§ 371 (c)(1),
(2), (4) Date: Aug. 14, 2008

(87) PCT Pub. No.: WO2007/093771

PCT Pub. Date: Aug. 23, 2007

(65) Prior Publication Data

US 2009/0020338 A1 Jan. 22, 2009

(30) Foreign Application Priority Data

Feb. 14, 2006 (GB) ..... 0602902.9
Nov. 20, 2006 (GB) ..... 0623702.8

(51) Int. Cl.
*E21B 10/46* (2006.01)

(52) U.S. Cl. ..... 175/325.3; 175/320

(58) Field of Classification Search ..... 175/320, 175/325.3, 408; 166/382, 241.1
See application file for complete search history.

(56) References Cited

U.S. PATENT DOCUMENTS

| | | | | |
|---|---|---|---|---|
| 2,562,346 | A | 7/1951 | Whittaker | |
| 4,102,552 | A * | 7/1978 | Kellner | 175/325.3 |
| 4,793,425 | A * | 12/1988 | White | 175/325.2 |
| 5,667,027 | A * | 9/1997 | Poffenroth | 175/325.3 |
| 5,810,100 | A * | 9/1998 | Samford | 175/325.3 |
| 6,622,803 | B2 * | 9/2003 | Harvey et al. | 175/325.3 |
| 2002/0023782 | A1 * | 2/2002 | Appleton et al. | 175/325.3 |
| 2004/0026131 | A1 * | 2/2004 | Boulet et al. | 175/325.3 |
| 2004/0211570 | A1 | 10/2004 | Chen et al. | |

FOREIGN PATENT DOCUMENTS

| | | |
|---|---|---|
| EP | 0534037 | 3/1993 |
| EP | 1174584 | 1/2002 |

(Continued)

OTHER PUBLICATIONS

Morrish, Susan, International Search Report, Jun. 27, 2007, 3 pages, European Patent Office, Rijswijk, NL.

*Primary Examiner*—Daniel P Stephenson
(74) *Attorney, Agent, or Firm*—Mark A. Oathout

(57) ABSTRACT

This invention relates to a downhole assembly and to a cutter assembly, and in particular to a downhole assembly including an apparatus for breaking up large-scale material which is present behind a drill bit, and to a cutter assembly for use in such a downhole assembly. The downhole assembly is suitably for use in a drillstring, the downhole assembly comprising a drill bit, a sensitive component, and at least one rotatable set of cutter blades located between the drill bit and the sensitive component.

6 Claims, 4 Drawing Sheets

FOREIGN PATENT DOCUMENTS

| | | |
|---|---|---|
| GB | 2323875 | 10/1998 |
| GB | 2398587 | 8/2004 |
| WO | WO 01/94738 | 12/2001 |
| WO | WO 02/081858 | 10/2002 |
| WO | WO 2004/029402 | 4/2004 |

* cited by examiner

DOWNHOLE ASSEMBLY AND CUTTER ASSEMBLY

CROSS-REFERENCE TO RELATED APPLICATIONS

This application is the National Stage of International Application No. PCT/GB2007/000477 filed Feb. 13, 2007.

STATEMENTS REGARDING FEDERALLY SPONSORED RESEARCH OR DEVELOPMENT

Not Applicable.

REFERENCE TO A MICROFICHE APPENDIX

Not Applicable.

FIELD OF THE INVENTION

This invention relates to a downhole assembly and to a cutter assembly, and in particular to a downhole assembly including an apparatus for breaking up large-scale material which is present behind a drill bit, and to a cutter assembly for use in such a downhole assembly.

BACKGROUND TO THE INVENTION

During drilling operations, and in particular drilling operations for oil and gas reserves, it is often necessary to break up large-scale downhole material which is present behind the drill bit. One example of large-scale downhole material is parts of a pump-down plug, wiper plug, landing collar, float collar, float shoe etc., which have been used in the process of adding cement around a string of tubular casing.

A casing will be used, for example, to provide support for a particular section of the borehole, i.e. it might be determined that the material surrounding that section of the borehole cannot support the pressure of the drilling fluid or mud which is pumped into the borehole. In such circumstances, it is usual to drill a large-diameter borehole to the depth at which the casing is required, to remove the drill string, to insert a tubular casing which has a diameter slightly smaller than the diameter of the borehole, and to pump a cementitious material into the annular gap between the casing and the borehole wall. The drilling operation continues with a smaller-diameter drill passing through the casing.

It is not uncommon for a borehole to be formed by a series of reducing-diameter drilled sections, with each section lined by a string of tubular casing or tubular liner.

To prevent the casing filling with dirt and debris during its insertion into the borehole, its bottom end may be fitted with a shoe and float valve so that it becomes necessary for the drill to break up the shoe and float valve before drilling of the next borehole section can proceed. In addition, the casing will typically be fitted with a landing collar to receive at least two plugs, the first of which precedes the cement as this is pumped into the casing, and the second of which follows the cement, the plugs separating the cement from the drilling fluid within the casing. Typically, the first plug will contain a valve which opens when the plug engages the shoe at the bottom of the casing, allowing cement through the plug and into the volume between the casing and the borehole.

The distance between the plugs, and the volume of concrete which can be contained within the casing between the plugs, will be calculated in advance based upon the volume of cement required to fill the annular gap around the casing.

It is also necessary to drill out the plugs and landing collar before the drilling operation can continue.

The borehole will typically be drilled to a depth slightly greater than that required for the casing, so that the casing does not reach the bottom of the borehole. During the cementing stage, it is common for the bottom of the borehole (i.e. that region below the bottom of the casing, and which is often referred to as the "rat hole") to be partially or totally filled with cement and other debris. The material which is located in the rat hole must also be drilled out before the drilling operation can continue.

The plugs, landing collar, float valves and shoe are made of a material, and the rat hole may contain a material, different to that through which the borehole is being drilled. The drill bit is suited to drilling a particular material such as rock, and whilst it is possible to fit a specialised drill bit for the sole purpose of breaking up the plugs, landing collar, float valves, shoe and material within the rat hole, this is usually not economic as it can for example take up to 1-2 days to pass the specialised drill bit down to a typical casing shoe depth, drill out the plugs, landing collar, float valves, shoe and rat hole, return the specialised drill bit to the surface, and then introduce the regular drill bit. With the cost of 1 day's use of a drilling rig being typically in the hundreds of thousands of US Dollars, it is preferable to avoid unnecessary trips up and down the borehole. Accordingly, a specialised drill bit is not often used, and instead a drill bit and drilling assembly which are suited to the surrounding rock or earth are used to penetrate the plugs, landing collar, float valves, shoe and contents of the rat hole before they can continue drilling into the rock or earth.

It is known to make the plugs from a friable material, i.e. a material which is susceptible to drilling by the regular drill bit, and which is designed to break up into small-scale pieces when drilled. However, such plugs are not in universal use, and many applications utilise plugs made from a combination of aluminium and rubber. It is a widely recognised disadvantage with plugs of this type that the drill bit will not break up these materials very efficiently, with the ductility of the aluminium, and the resilience of the rubber, allowing these materials to remain as large-scale materials in the form of ribbons, particles or chunks as they pass the drill bit.

The existence of large ribbons, particles or chunks of aluminium, rubber and the like can cause significant damage to other components of the downhole assembly. For example, the downhole assembly might include a steering component such as that described in our published patent application EP-A-1024245, and whilst that steering component (and other downhole componentry) is adapted to the downhole conditions including drilling fluids and entrained drill cuttings, the drill cuttings are usually small-sized particles, and the component may not be able to function in the presence of large-scale materials.

Specifically, the ribbons, large particles and/or chunks of aluminium, rubber and the like can foul parts of the steering component (e.g. become wedged or jammed against the component) and cause mechanical damage, and/or they can cause a pack-off, i.e. block the passage of drilling fluid around the steering component. The blockage of drilling fluid, even for a very short period of time, can result in a very large pressure drop (perhaps above 5,000 p.s.i. (approx $33\times10^6$ Pa)) across the steering component, which can lead to failure of the seals and the subsequent ingress of drilling fluid, for example.

SUMMARY OF THE INVENTION

The inventors have realised that an apparatus is required to break up the large-scale material so that the likelihood of the material damaging downhole componentry, or blocking the passage of drilling fluid, is reduced or avoided.

According to the invention therefore, there is provided a downhole assembly comprising a drill bit, a sensitive component, and at least one rotatable set of cutter blades located between the drill bit and the sensitive component.

The cutter blades are adapted to cut, grind or otherwise break up the large-scale material before it reaches the sensitive component. The sensitive component is the part of the downhole assembly which is desired to be protected from the large-scale material. In most downhole assemblies the sensitive component will be a steering component.

Reference herein to the set of cutter blades and other components being "rotatable" includes rotation relative to the drillstring and/or rotation relative to the borehole. Whether the set of cutter blades and other components can rotate relative to the drillstring and/or to the borehole will be made clear in relation to each of the embodiments.

Preferably, the cutter blades rotate independently of the drill string. Such independent rotation allows the cutter blades to rotate with the drillstring in certain circumstances, and to rotate relative to the drillstring in other circumstances. Alternatively, the cutter blades rotate directly with the drillstring, or dependent upon the drillstring.

Cutter blades which rotate relative to other parts of the downhole assembly and/or relative to the borehole are able to cut or break up the large-scale material by pressing and grinding the large-scale material against the borehole wall and other parts of the downhole assembly, for example.

Because the cutter blades are located between the drill bit and the sensitive component, they are not required during normal drilling operations, and in particular do not need to be designed to cut or break up rock or the like. Instead, they can be designed to maximise their efficiency for cutting and/or breaking up the large-scale material expected to be encountered, for example the aluminium and/or rubber which are used in the casing plugs, the material of the casing shoe, and/or the material likely to be encountered in the rat hole.

It is particularly desirable that the cutter blades be configured as a greater obstruction to the passage of large-scale material than the sensitive component, so that if the material is able to pass the cutter blades it is also able to pass the sensitive component.

Even if the large-scale material temporarily blocks the passage of drilling fluid at the cutter blades, and causes a large pressure drop across the cutter blades, it is arranged that this will not cause damage to the blades as these can be designed to be very pressure-insensitive. In any event, the pressure drop across the cutter blades will avoid or reduce the likelihood of a large and damaging pressure drop across the sensitive component.

Preferably, the cutter blades are mounted on an annular sleeve which is in turn mounted upon bearings. In this way, the annular sleeve and cutter blades can rotate independently of the remainder of the drill string. In normal drilling operations, the drilling fluid and entrained drill cuttings can pass the cutter blades without significant hindrance. In these circumstances, the annular sleeve and cutter blades typically rotate with the drill string, i.e. despite the presence of bearings the friction between the rotating drill string and the annular sleeve is likely to be greater than the resistance to rotation of the annular sleeve and cutter blades. However, when large-scale material is required to pass, the cutter blades will typically slow down or stop rotating altogether, and will trap the large-scale material. Once trapped, the large-scale material will be broken up or ground down by the interaction between the rotating parts of the downhole assembly (which are preferably roughened or otherwise made abrasive or are adapted to cut the material) and the non-rotating (or slower-rotating) cutter blades.

Preferably, the cutter blades are part of a cutter assembly which is located in the downhole assembly, the cutter assembly having an internal passageway for the passage of drilling fluid to the drill bit, and a set of external passageways for the return of drilling fluid and drill cuttings to the surface.

The cutter assembly can include a further part which rotates at a different rate to the cutter blades, the cutter blades being located adjacent to the further part. The action of the cutter blades rotating adjacent to the further part will cause the cutter blades to act like a series of shears adapted to cut up the large-scale material. Accordingly, it can be arranged that the cutter blades act to cut the large-scale material into smaller pieces. Alternatively (or additionally), the cutter blades can be made abrasive so that they act to grind the large-scale material into smaller pieces, perhaps whilst the large-scale material is trapped against the borehole wall or another part of the downhole assembly. The smaller pieces should be small enough to pass the sensitive component along with the drill cuttings. Thus, despite using the general term "cutter blades", it is recognised that in some embodiments the blades do not cut like shears, but instead act to grind the large-scale material, or merely to trap and hold the material as it is otherwise ground or broken down.

The cutter assembly can be located upon a stabiliser housing.

If there are two or more sets of cutter blades, it is arranged that they are out of register, i.e. the gaps between the cutter blades in one set are out of alignment with the gaps between the cutter blades in the other set(s).

Desirably, the cutter assembly also includes gearing for the cutter blades, so that the cutter blades are driven to rotate at a different rate than other parts of the cutter assembly. The cutter blades can rotate with the remainder of the cutter assembly (and drill string) when there is little or no resistance to rotation of the cutter blades, and can rotate at the chosen different rate when there is resistance to rotation.

BRIEF DESCRIPTION OF THE DRAWINGS

The invention will be described, by way of example, with reference to the accompanying drawings, in which.

DETAILED DESCRIPTION

Figure 1:
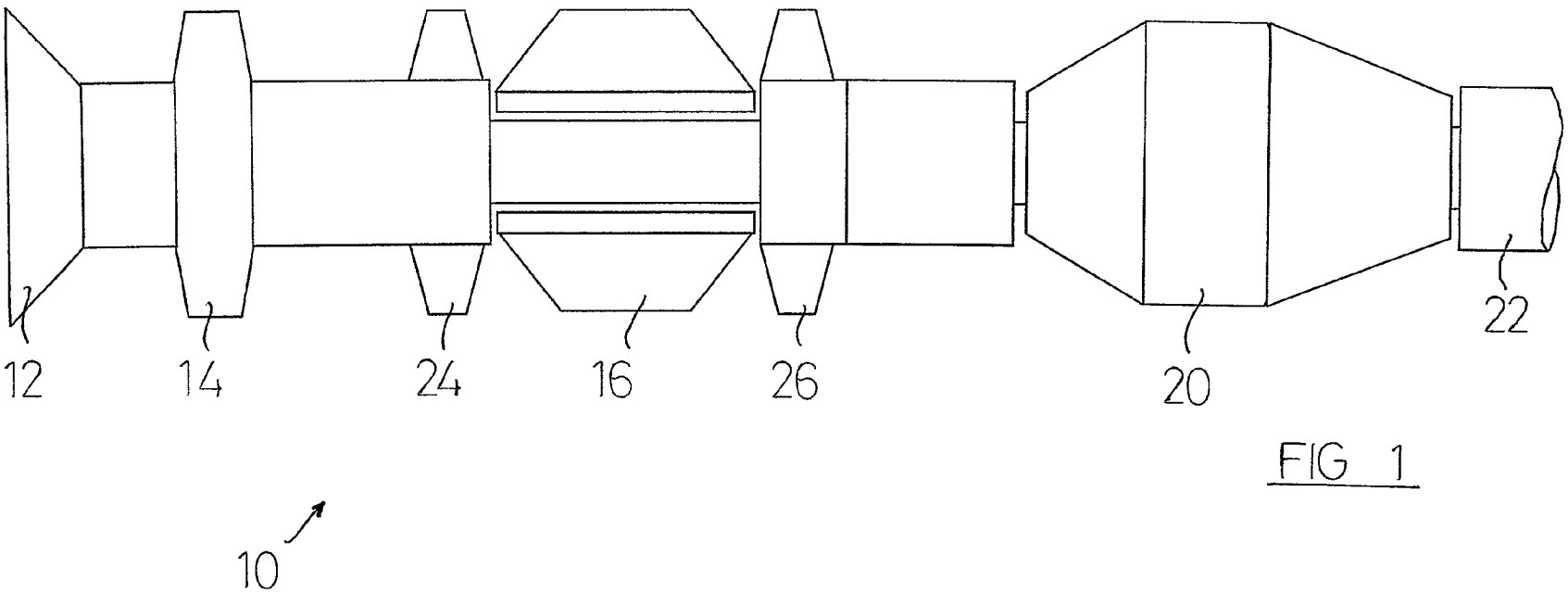
FIG. 1 shows a schematic side view of a downhole drilling assembly according to the present invention.
Figure 2B:
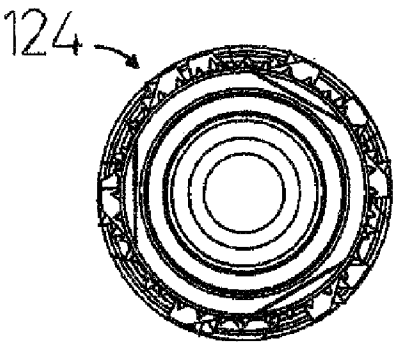
FIG. 2*b* shows an end view of the stabiliser of FIG. 2*a;*
Figure 2D:
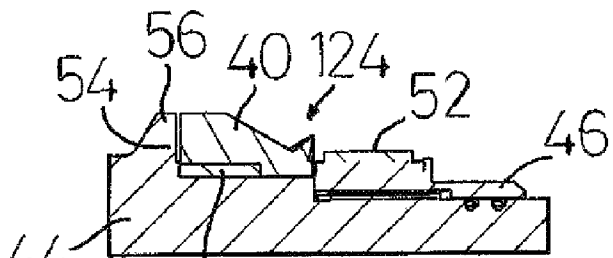
FIG. 2*d* shows an enlarged view of the part of the stabiliser within the dashed box of FIG. 2*c;*
Figure 2A:
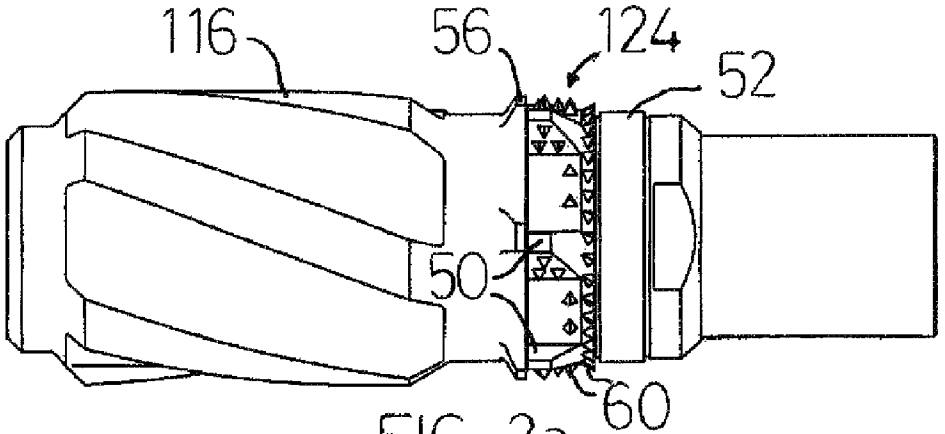
FIG. 2*a* shows a side view of a stabiliser incorporating a first embodiment of cutter assembly according to the present invention.
Figure 2C:
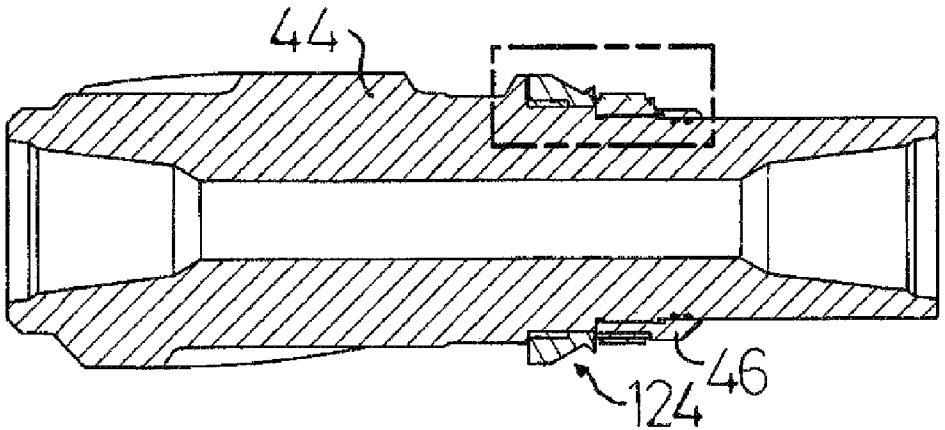
FIG. 2*c* shows a sectional view through the stabiliser of FIG. 2*a;*
Figure 3B:
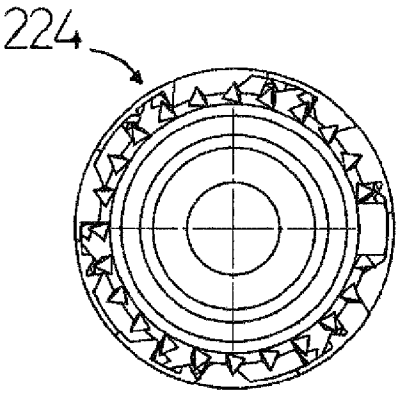
FIG. 3*b* shows an end view of the stabiliser of FIG. 3*a;*
Figure 3D:
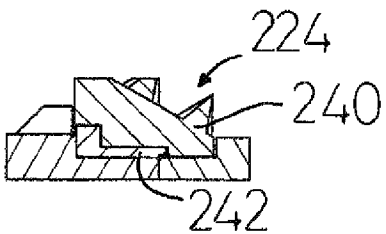
FIG. 3*d* shows an enlarged view of the part of the stabiliser within the dashed box of FIG. 3*c;*
Figure 3A:
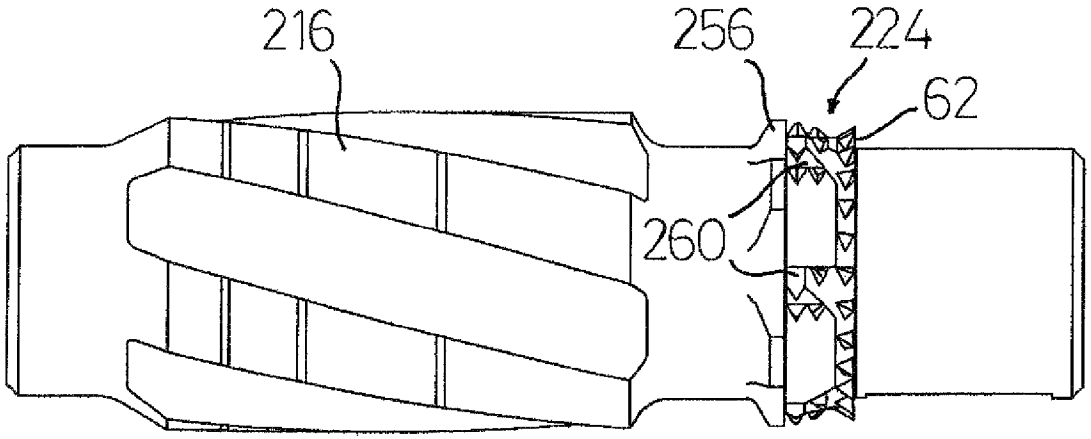
FIG. 3*a* shows a side view of a stabiliser incorporating a second embodiment of cutter assembly.
Figure 3C:
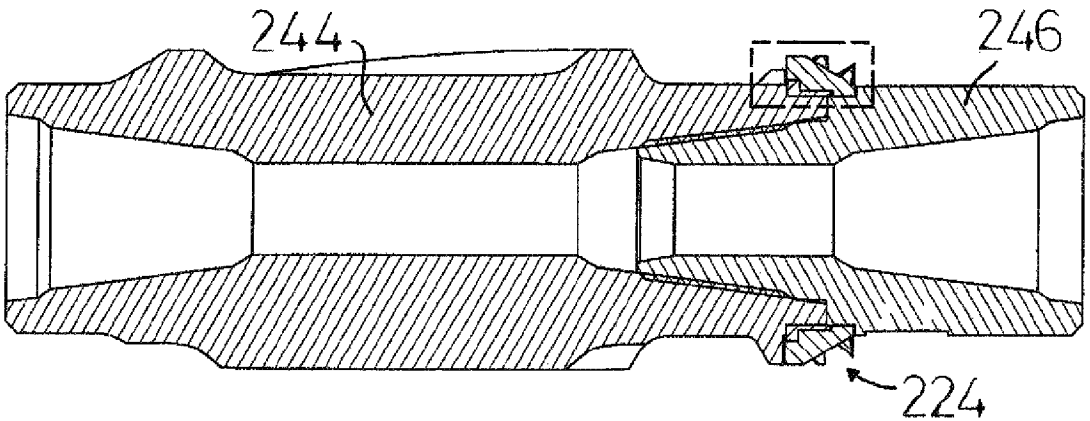
FIG. 3*c* shows a sectional view through the stabiliser of FIG. 3*a;*

The downhole assembly 10 shown schematically in FIG. 1 comprises a drill bit 12, a near-bit stabiliser 14, a pivot stabiliser 16, and a steering component 20. The steering component 20 is connected to the bottom end of a drill string 22, the top end of which is connected to a drilling rig or the like at the surface (not seen).

It will be understood that in common with prior art downhole assemblies the drillstring 22, the steering component 20, and the stabilisers 16 and 14, are hollow so as to provide a passageway for the transmission of drilling fluid or mud to the drill bit 12. In addition, these components do not fill the drilled borehole, but instead allow the passage of drilling fluid and drill cuttings back to the surface around the outside of these components (or though channels in the outer surfaces of these components).

It will also be understood that the near-bit stabiliser 14 serves to centralise the drill bit 12 within the borehole, and can also serve to ream the borehole to ensure that it is closer to the designed diameter. The near-bit stabiliser is optional and is not required for all drill bits, and in particular is not a part of the present invention.

In the downhole assembly 10 the steering component 20 is the sensitive component which is desired to be protected from large-scale material which is present behind the drill bit.

In a conventional downhole assembly containing only those components 12, 14, 16 and 20 so far described, the drill bit 12 would be designed to cut rock or other material through which the borehole is being drilled, the drill bit being designed to cut or grind the rock into small-scale particles which become entrained in the drilling fluid and are carried to the surface around the stabilisers 14, 16 and steering component 20.

When the drill bit 12 encounters other materials such as the casing plugs, the casing shoe, and the material in the rat hole, however, the drill bit is not designed for those different materials, and it is known for large-scale particles of aluminium and rubber for example to pass the drill bit 12, stabilisers 14, 16, and foul the steering component 20. Specifically, the channels (not shown) which are provided around the steering component 20, and through which the drilling mud and drill cuttings can pass to the surface, cannot always accommodate the large-scale material, the channels becoming partially or fully blocked by the large-scale material (which may be a very effective sealing material such as rubber for example).

The mechanical complexity of the components which are used in downhole assemblies is generally increasing, and as the components become more complex they usually also become more sensitive to adverse conditions. Steering components which can drive the drill bit to move in a chosen direction are particularly complex and sensitive, and a pressure drop of 5,000 p.s.i. (approx. $33\times10^6$ Pa) across the steering component, which can occur if the channels become blocked, will cause mechanical damage to most steering components.

To avoid or reduce the likelihood of large-scale material encountering the steering component 20, in the embodiment of FIG. 1 a first set of cutter blades 24 is located ahead of the pivot stabiliser 16 (i.e. between the drill bit 12 and the pivot stabiliser 16) and a second set of cutter blades 26 is located behind the pivot stabiliser 16 (i.e. between the pivot stabiliser 16 and the steering component 20).

The cutter blades in all of the embodiments are configured to be particularly suited to cutting and/or breaking and/or grinding the large-scale material expected to be encountered. For example, if the downhole assembly 10 is to be used in a drilling operation which will include a casing for which plugs of aluminium and rubber are to be used, then the cutter blades are configured to cut, grind and/or break up aluminium and rubber. The cutter blades can be made from or coated with a particularly abrasive material, and can be shaped to push large-scale material against the borehole wall where it can be cut, broken or ground into small particles. The particular degree of roughening, and/or the abrasive material which is used, can be determined according to the materials likely to be encountered, but it is expected that crushed carbide in a matrix will be a suitable material in most applications, and in particular HF 1000⅛ inch crushed carbide, which is a known abrasive material used in drilling applications.

In this embodiment the sets of cutter blades 24, 26 are mounted to rotate with the drill string 22.

It will be understood that the stabiliser 16 has a number of channels through which the drilling fluid and drill cuttings can pass. In this embodiment the stabiliser 16 is intended to be non-rotating. Thus, whilst the whole of the drillstring 22 is rotated from the surface, the stabiliser is rotatable relative to the drillstring, and is designed to be substantially non-rotating relative to the borehole, i.e. the stabiliser 16 slides along the surface of the borehole as the borehole depth increases.

In the embodiment of FIG. 1 the stabiliser 16 and the sets of cutter blades 24, 26 are all tapering towards the borehole wall. In an alternative embodiment the edges of the cutter blades and the edges of the stabiliser are parallel and have a very small spacing therebetween, so that the cutter blades and the edges of the channels in the stabiliser provide a series of "shears" acting to cut up the large-scale material as the sets of blades rotate adjacent to the non-rotating stabiliser.

In this embodiment the set of cutter blades 24 is a single row of cutter blades arranged around the central hollow shaft. In other embodiments there could be two or more rows of cutter blades, of varying spacing and dimensions, with each row offset from its neighbour(s), as desired to maximise the cutting, breaking and/or grinding of the large-scale material.

It is desired in particular that the set(s) of cutter blades, and in particular the first set of cutter blades 24, presents a greater obstacle to the passage of the large-scale material than does the steering component 20. In this way, the set of cutter blades 24 provides the greatest restriction to passage of the large-scale material, and material which passes the set of cutter blades 24 should also pass the steering component 20. Also, if the large-scale material is not immediately cut, broken or ground by the set of cutter blades 24, and a large pressure drop occurs across the set of cutter blades 24, the cutter blades are substantially pressure insensitive so that mechanical damage is extremely unlikely to occur.

In the embodiments of FIGS. 2-4 the cutter assembly is incorporated into a stabiliser component, and for simplicity only the stabiliser component is shown. It will be understood that in a typical drill string the stabiliser component shown is mounted between the drill bit and a sensitive component such as a steering component, as in FIG. 1.

In these embodiments, the set of cutter blades 124, 224, 324 are mounted directly upon the stabiliser 116, 216, 316 respectively, but in other embodiments the set(s) of cutter blades and other parts of the cutter assembly could be separate from the stabiliser and mounted between the stabiliser and the drill bit as are the cutter blades 24 of FIG. 1.

Alternatively, the cutter blades could be mounted between the stabiliser and the sensitive component, but this is less preferred as it is desired to mount the cutter blades directly downstream of the drill bit so that any large scale material is cut or ground up before passing any other componentry.

Also in the embodiments of FIGS. 2-4 the stabiliser is a rotating stabiliser, in that the stabiliser 116, 216, 316 is designed to rotate with the drill string. These embodiments could, however, be used with a non-rotating stabiliser (i.e. a stabiliser which does not rotate with the remainder of the drill string), or a freely mounted stabiliser (i.e. a stabiliser which can rotate with the drill string but which will cease rotating when it is forced against the borehole wall) as desired.

In the embodiment of FIGS. 2*a-d*, the set of cutter blades 124 is mounted upon an annular sleeve 40 which is mounted by way of bearings 42 upon a part of the stabiliser body 44. The annular sleeve 40 is retained by way of a collar 46 which is threaded onto the stabiliser body 44. As with the other components of the drill string, it is arranged that rotation of the drill string relative to the borehole (not shown) acts to tighten the collar 46 upon its respective threads, so that the collar does not inadvertently become loosened or removed during use.

The collar 46 has a roughened and/or abrasive surface part 52.

The collar 46 retains the annular sleeve 40 against a shoulder 54 of the stabiliser, the shoulder 54 having a number of raised lugs 56. The surfaces of the shoulder 54 and lugs 56 are also roughened and/or made abrasive, perhaps by the same material as the surface part 52.

The set of cutter blades 124 comprises a number of teeth 60 and a number of raised lugs 50. In this embodiment the teeth 60 are of substantially tetrahedral form, which present a cutting tip as well as three cutting edges. The teeth 60 are made of a hard material, and in this embodiment are made smooth to provide cutting edges. In alternative embodiments some or all of the surfaces of the cutter blades can be roughened and/or made abrasive. In this embodiment the cutter blades are made of carbide and each blade or tooth 60 is spot welded onto the stainless steel sleeve 40. The lugs 50 are of similar form to the lugs 56 and the respective lugs acts as shears when there is relative rotation between the set of cutter blades 124 and the stabiliser body 44. The lugs 50 also carry teeth 60, as shown.

The mounting of the sleeve 40 is such that it can rotate substantially freely upon the stabiliser body 44. However, in normal use it is expected that the sleeve 40 will rotate at substantially the same rate as the stabiliser 116, i.e. it is expected that the friction between the sleeve 40 and the stabiliser 116 will be greater than the resistance to rotation of the sleeve. Whether or not the sleeve 40 rotates in normal use is not relevant to the present invention, however, since the cutter blades are not provided for normal drilling operations, but for those occasions when the drill bit is caused to cut casing plugs for example.

When the drill bit does cut casing plugs and the like, any large-scale material which engages the cutter blades 124 will cause the sleeve 40 to slow down or even stop. The outwardly tapering configuration of the cutter blades 124 is such that they act to force the large-scale material against the borehole where it can be ground or broken up as the drillstring continues to advance along the borehole. In addition, the collar 46 and the shoulder 54 and lugs 56 continue to rotate with the drillstring, and the relative rotation between the cutter blades 124 and the surfaces of these parts, and consequently the relative rotation between the entrapped large-scale material and one or both of the cutter blades 124 and these surfaces will act to cut, grind up and/or break down the large-scale material. In addition, there is a shearing action between the raised lugs 50 and the lugs 56. Accordingly, the surface 52, the sleeve 40 with its set of cutter blades 124, and the surfaces of the shoulder 54 and its lugs 56, together form a cutter assembly for the large-scale material.

The embodiment of FIGS. 3*a-d* is similar to that of FIGS. 2*a-d*, differing primarily in the mounting of the set of cutter blades 224. In this embodiment the set of cutter blades 224 is mounted upon an annular sleeve 240 which is mounted by way of bearings 242 upon a part of the stabiliser body 244. The annular sleeve 240 is retained by way of a coupling 246 which is threaded onto the stabiliser body 244.

In addition, the arrangement of the set of cutter blades 224 differs slightly from that of the cutter blades 124. In the embodiment of FIGS. 3*a-d* the set of cutter blades 224 comprises a ring 62 of teeth (which may be identical to the teeth 60 of FIGS. 2*a-d*), and a number of raised lugs 260 (upon which are also mounted teeth).

It will be understood that the precise form and arrangement of the cutter blades, and the precise form, number and arrangement of the teeth thereof, can be varied to suit particular applications, and to suit the large-scale materials which are likely to be encountered. Experiments may be necessary to determine the optimum form, number and arrangement of the sets of cutter blades for a particular application.

As is in the embodiment of FIGS. 2*a-d*, the number of raised lugs 260 on the sleeve 240 does not match the number of lugs 256 on the stabiliser body 244, so that the respective lugs cannot all become aligned. Misalignment between at least some of the respective lugs will help ensure the trapping of large-scale material.

In the embodiments of FIGS. 2*a-d* and 3*a-d*, the sets of cutter blades 124, 224 can substantially freewheel relative to the remainder of the drillstring. In tests such embodiments have been found to be particularly suitable for cutting and/or grinding up large-scale material as may be encountered when cutting casing plugs and the like. However, in some applications it may be desired that the cutter blades, and/or an adjacent abrasive and/or shearing part, can be driven to rotate at a different rate to the drill string, and such an arrangement is shown in FIGS. 4*a-d*.

In the embodiment of FIGS. 4*a-d* the set of cutter blades 324 is mounted upon a sleeve 340 which is in turn mounted upon bearings upon the stabiliser body 344. Adjacent to the set of cutter blades 324 is mounted another sleeve 64 which can also rotate relative to the stabiliser body 344. The sleeve 64 has an outer surface with a series of raised lugs 66 which act together with the raised lugs 360 of the cutter blades 324 in a shearing action. The lumber of lugs 66 does not match the number of lugs 360. The surface of the sleeve 64, and the surfaces of the lugs 66, are made abrasive.

The sleeve 64 is mounted between the sleeve 340 and the lugs 356 of the stabiliser body 344. The number of lugs 356 does not match the number of lugs 66.

Figure 4B:
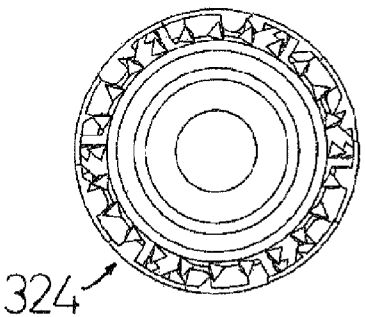
FIG. 4*b* shows an end view of the stabiliser of FIG. 4*a;*
Figure 4D:
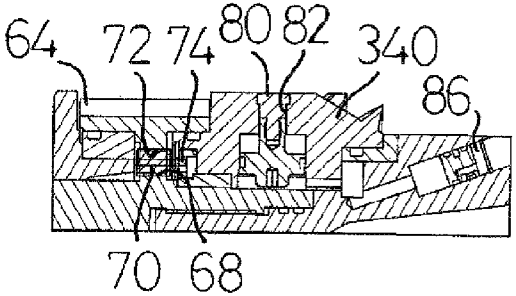
FIG. 4*d* shows an enlarged view of the part of the stabiliser within the dashed box of FIG. 4*c*.
Figure 4A:
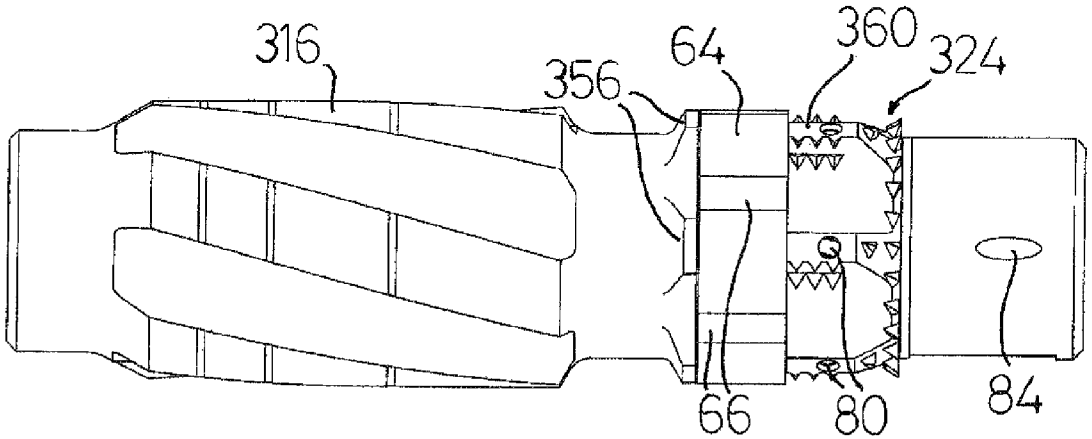
FIG. 4*a* shows a side view of a stabiliser incorporating a third embodiment of cutter assembly.
Figure 4C:
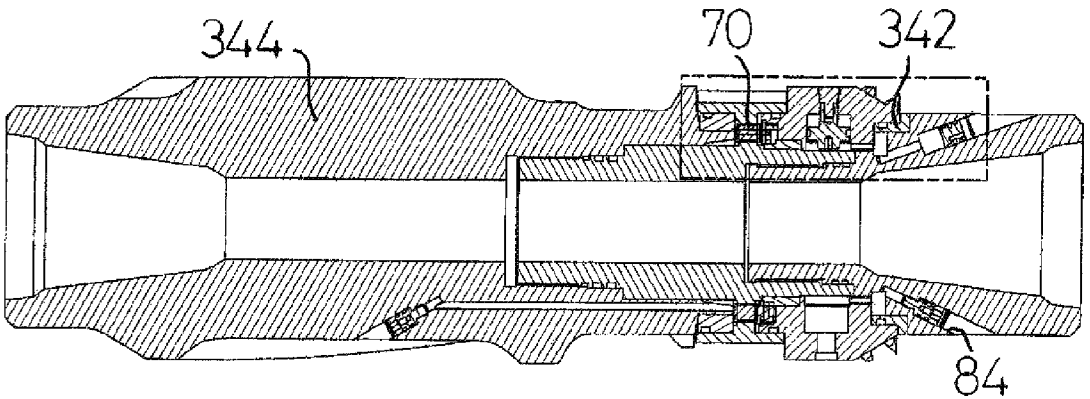
FIG. 4*c* shows a sectional view through the stabiliser of FIG. 4*a*.

Beneath the sleeve 64 the stabiliser has a ring gear 68, the gear teeth of which are engaged by a set of planetary gear wheels 70 (only one of which can be seen in the enlarged view of FIG. 4*d*). The gear wheels 70 also engage the gear teeth of a ring gear 72 of the sleeve 64. The respective axles 74 for the gear wheels 70 are mounted in bearings upon the sleeve 340.

In ordinary use the sleeve 340 rotates with the drillstring, and since the axles 74 are rotating with the sleeve 340 the gear wheels 70 are simply carried around with the ring gear and consequently the sleeve 64 is likewise rotating at the same rate. However, when the cutter blades 324 encounter large-scale material the rate of rotation of the sleeve 340 reduces. In such circumstances the axles 74 rotate at a different rate to the ring gear 68 and the gear wheels 70 are driven to rotate by the ring gear 68, and consequently the sleeve 64 is thereby driven to rotate by its ring gear 72.

It will be understood that the cutter blades 324 can therefore rotate at a different rate to the sleeve 64 and its lugs 66, which is turn rotates at a different rate to the stabiliser body 344 and its lugs 356, the relative rotations between the respective parts of the cutter assembly enhancing the shearing and grinding actions.

Notwithstanding the advantages of such an embodiment as described above, the embodiment of FIGS. 4*a-d* additionally has a braking means which can stop the sleeve 340 from rotating, and thereby cause the sleeve 64 to contra-rotate. Specifically, the stabiliser 344 carries a number of braking pistons 80 which are mounted to slide in respective bores 82. The bores 82 are connected by internal passageways to entry bores 84 which carry respective sealing pistons 86.

It will be recognised that the presence of large-scale material engaging the cutter blades 324 causes a pressure build-up within the drilling fluid upstream of the cutter blades, i.e. the flowing drilling fluid encounters a temporarily restricted path past the cutter blades. When such a pressure build-up occurs, the pressure at the entrance to the entry bores 84 will exceed the pressure above the braking pistons 80, and it is arranged that such a pressure differential causes the sealing pistons 86 to be driven inwards along the entry bores 84 and the braking pistons to be driven outwards against the borehole (not shown). Engagement of the braking pistons with the borehole will cause the sleeve 340 to slow down further (and eventually stop). Thus, even if the presence of the large-scale material does not itself cause the sleeve 340 to stop rotating, the braking pistons 80 will do so whilst the pressure differential remains.

It will be understood that if the sleeve 340 stops rotating the axles 74 will stop rotating, but the stabiliser body 344 continues to rotate with the drillstring whereupon the ring gear 68 continues to rotate, driving the gear wheels 70 to rotate and so driving the ring gear 72 and the sleeve 64 to rotate, in the opposite direction (and at the same rate of rotation as the drillstring). In such circumstances, the large-scale material faces a flow path comprising a stationary sleeve 340 and stationary set of cutter blades 324, an abrasive sleeve 64 and its shearing lugs 66 rotating at a predetermined rate in a first direction, and then an abrasive surface of the stabiliser body 344 and its shearing lugs 356 rotating at the predetermined rate in a second direction opposite to the first direction.

When the large-scale material has been cut, broken up and/or ground down into small pieces which can safely pass the cutter assembly (and also the downstream sensitive component), the pressure differential is removed, and the relatively increased pressure above the braking pistons 80, and the relatively reduced pressure at the entrance to the entry bores 84, will cause the braking pistons to retract into the bores 82. The sleeve 340 can then resume its rotation with the stabiliser 344.

In this embodiment the sleeve 64 is driven to rotate at a different rate to the sleeve 340 and cutter blades 324 (and also at a different rate to the remainder of the stabiliser 344 and drillstring). However, it will be understood that the functions of the sleeves 340 and 64 could easily be reversed, so that the sleeve 64 is first caused to stop rotating which drives the cutter blades 324 to rotate at a different rate to the stabiliser 344. Alternatively (or additionally) the positions of the sleeves 64 and 340 could be reversed if desired. Alternatively (or additionally) again, the sleeve 64 could carry an additional set of cutter blades.

The invention claimed is:

1. A cutter assembly for use with a drill bit and a sensitive component in a downhole assembly, the cutter assembly comprising a rotatable set of cutter blades and a further part which can rotate at a different rate to the set of cutter blades, the cutter blades being located adjacent to the further part, the cutter assembly having gearing so that the set of cutter blades and the further part can be driven to rotate at different rates.

2. The cutter assembly according to claim 1 including a braking mechanism which is engageable with the surface of a drilled borehole in use, the braking mechanism being adapted to reduce the rate of rotation of the set of cutter blades.

3. The cutter assembly according to claim 1 in which the gearing comprises an inner ring gear mounted upon a part of the cutter assembly, an outer ring gear mounted upon the further part, and a set of planetary gear wheels which lie between the ring gears and engage both of the ring gears, the axles for the planetary gear wheels being mounted for rotation with the cutter blades.

4. A downhole assembly for use in a drillstring, the downhole assembly comprising a drill bit, a sensitive component, and a cutter assembly located between the drill bit and the sensitive component, the cutter assembly comprising at least one set of cutter blades which are mounted to rotate with the drillstring and a further part which is mounted to rotate relative to the drillstring, the cutter blades being located adjacent to the further element, in which the set of cutter blades is a first set of cutter blades and the assembly has a second set of cutter blades, the first set of cutter blades being located between the further part and the drill bit and the second set of cutter blades being located between the further part and the sensitive component.

5. The downhole assembly of claim 4 in which the gaps between the first set of cutter blades are out of alignment with the gaps between the second set of cutter blades.

6. A downhole assembly comprising a drill bit, a sensitive component, and a cutter assembly located between the drill bit and the sensitive component, the cutter assembly including a set of cutter blades, a further part, and gearing whereby the set of cutter blades and the further part can be driven to rotate at different rates.

* * * * *